United States Patent [19]

Haines et al.

[11] Patent Number: 5,058,025

[45] Date of Patent: Oct. 15, 1991

[54] EMERGENCY POST OFFICE SETTING FOR REMOTE SETTING METER

[75] Inventors: John G. Haines, Oakland; Tracy F. Slaughter, Grass Valley; Charles P. Barker, Pleasanton, all of Calif.

[73] Assignee: F.M.E. Corporation, Hayward, Calif.

[21] Appl. No.: 327,487

[22] Filed: Mar. 23, 1989

[51] Int. Cl.[5] ..... G07B 17/00

[52] U.S. Cl. ..... 364/464.02; 235/382

[58] Field of Search ..... 364/900, 464.02; 235/382, 382.5

[56] References Cited

U.S. PATENT DOCUMENTS

| | | | |
|---|---|---|---|
| 3,034,329 | 5/1962 | Pitney et al. | 70/314 |
| 3,654,604 | 4/1972 | Crafton | 380/23 |
| 3,792,446 | 2/1974 | McFiggins et al. | 364/900 |
| 3,798,359 | 3/1974 | Feistel | 380/37 |
| 3,798,360 | 3/1974 | Feistel | 380/37 |
| 3,800,284 | 3/1974 | Zucker et al. | 340/825.31 |
| 3,860,911 | 1/1975 | Hinman et al. | 340/825.31 |
| 4,097,923 | 6/1978 | Eckert, Jr. et al. | 364/900 |
| 4,182,933 | 1/1980 | Rosenblum | 380/21 |
| 4,222,518 | 9/1980 | Simjian | 235/375 |
| 4,226,360 | 10/1980 | Simjian | 235/375 |
| 4,249,071 | 2/1981 | Simjian | 235/375 |
| 4,253,158 | 2/1981 | McFiggans | 364/900 |
| 4,280,179 | 7/1981 | Jones, Jr. et al. | 364/464.02 |
| 4,280,180 | 7/1981 | Eckert et al. | 364/900 X |
| 4,302,821 | 11/1981 | Eckert et al. | 364/900 |
| 4,310,720 | 1/1982 | Check, Jr. | 364/900 X |
| 4,314,097 | 2/1982 | Campbell, Jr. | 235/380 X |
| 4,376,299 | 3/1983 | Rivest | 364/900 |
| 4,424,573 | 1/1984 | Eckert, Jr. et al. | 364/900 |
| 4,447,890 | 5/1984 | Duwel et al. | 364/900 |
| 4,481,604 | 11/1984 | Gilham et al. | 364/900 |
| 4,484,307 | 11/1984 | Quatse et al. | 364/900 |
| 4,528,644 | 7/1985 | Soderberg et al. | 364/900 |
| 4,562,535 | 12/1985 | Vincent et al. | 364/200 |
| 4,580,144 | 4/1986 | Calvi | 101/93.07 X |
| 4,636,975 | 1/1987 | Soderberg et al. | 364/900 |
| 4,787,045 | 11/1988 | Storace et al. | 364/464.02 |
| 4,812,992 | 3/1989 | Storace et al. | 364/464.02 |
| 4,812,994 | 3/1989 | Taylor et al. | 364/464.02 |
| 4,837,714 | 6/1989 | Brookner et al. | 364/550 |

FOREIGN PATENT DOCUMENTS 2636852 2/1978 Fed. Rep. of Germany .

*Primary Examiner*—Parshotam S. Lall
*Assistant Examiner*—Edward R. Cosimano
*Attorney, Agent, or Firm*—Townsend and Townsend

[57] ABSTRACT

A technique for securely adding postage to a remote setting postage meter without the remote setting code. The technique is readily implemented in the meter software. During this technique, the meter is manually set by a Post Office Clerk by putting the meter into a post office mode by pressing selected keys, entering the desired amount of postage, and exiting the mode. After exiting the mode, the meter is capable of printing postage. After printing some non-zero postage, the customer notifys a data center computer of the manual setting by performing an emergency clear procedure. First, the customer puts the meter into a remote setting mode by pressing selected keys. In this mode, the meter will generate and display an emergency request code. The customer passes the emergency request code with other identifying information to the data center computer. The computer generates its own emergency request code and compares the codes. If they are equal, then the computer will communicate an emergency enable code to the customer for entry into the meter. Upon confirmation against an internally generated emergency enable code, the meter will enable itself to be remotely set again.

9 Claims, 6 Drawing Sheets

EMERGENCY POST OFFICE SETTING FOR REMOTE SETTING METER

Related copending applications include: "REMOTE METER CONFIGURATION", filed Mar. 23, 1989, Ser. No. 07/328,112; "REMOTE METER I/O CONFIGURATION", filed Mar. 23, 1989, Ser. No. 07/327,779; and "SECURITY EXTENSION PROCEDURE FOR REMOTE SETTING METER", filed Mar. 23, 1989, Ser. No. 07/328,099.

FIELD OF THE INVENTION

The present invention relates generally to postage meters and more particularly to electronic postage meters capable of being remotely set.

BACKGROUND OF THE INVENTION

With the advent of the electronic postage meters, it has become possible to offer meter customers the feature of remotely adding postage credit (remote setting) to the postage meter. This feature enables the customer to more readily and conveniently remotely set the amount of postage in the meter. Extensive procedures and controls are used to insure that the postage amount is remotely set only when authorized. For example, the customer is usually required to enter a long code that varies each time the meter is remotely set. However, there may be a time delay between the time customer first initiates the process of obtaining the remote setting code and the time the customer receives the remote setting code. In addition, the customer may not be able to remotely set the meter due to a low customer account balance.

SUMMARY OF THE INVENTION

The present invention provides a technique for securely adding postage to a remote setting postage meter without the remote setting code. The technique is readily implemented in the meter software.

During this technique, the meter is manually set by a Post Office Clerk by putting the meter into a post office mode by pressing selected keys, entering the desired amount of postage, and exiting the mode. After exiting the mode, the meter is capable of printing postage. After printing some non-zero postage, the customer notifies a data center computer of the manual setting by performing an emergency clear procedure. First, the customer puts the meter into a remote setting mode by pressing selected keys. In this mode, the meter will generate and display an emergency request code. The customer passes the emergency request code with other identifying information to the data center computer. The computer generates its own emergency request code and compares the codes. If they are equal, then the computer will communicate an emergency enable code to the customer for entry into the meter. Upon confirmation against an internally generated emergency enable code, the meter will enable itself to be remotely set again.

DETAILED DESCRIPTION OF THE PREFERRED EMBODIMENT

Meter Overview Structure

Figure 1:
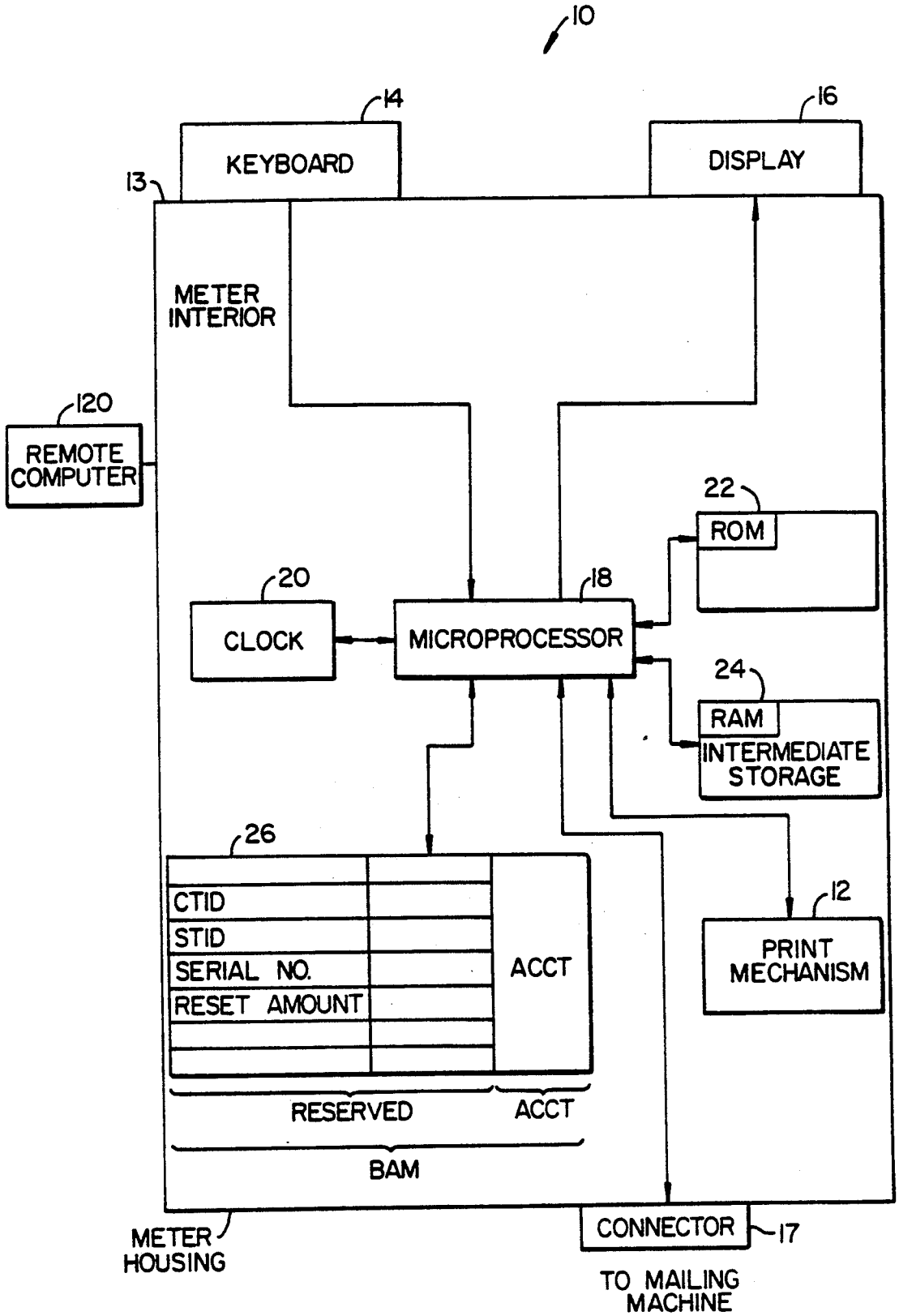
FIG. 1 is a block diagram of a preferred postage meter capable of being remotely set in the field by the customer.

FIG. 1 is a block diagram of a preferred postage meter 10 that can be remotely set in the field by the customer. Meter 10 includes a print mechanism 12, accounting registers, and control electronics, all enclosed within a secure meter housing 13. A keyboard 14 and a display 16 provide the user interface. A connector 17 provides an electrical connection with a mailing machine for control of the printing process. The control electronics includes a digital microprocessor 18 which controls the operation of the meter, including the basic functions of printing and accounting for postage, and optional features such as department accounting and remote setting. The microprocessor is connected to a clock 20, a read only memory (ROM) 22, a random access memory (RAM) 24, and a battery augmented memory (BAM) 26.

ROM 22 is primarily used for storing nonvolatile information such as software and data/function tables necessary to run the microprocessor. The ROM can only be changed at the factory. RAM 24 is used for intermediate storage of variables and other data during meter operation. BAM 26 is primarily used to store accounting information that must be kept when the meter is powered down. The BAM is also used for storing certain flags and other information that is necessary to the functioning of the microprocessor. Such information includes meter identifying data such as the meter serial number and BAM initialization date, and a number of parameters relevant to the remote configuration of the meter.

Meter Relationship with the Data Center Computer

Prior to being able to perform an emergency remote setting procedure, the meter must have been capable of being remotely set. However, the meter cannot be remotely set until it has been "installed" at a customer site by an Installation Procedure (see Appendix A) which links the meter, the customer, and the customer lease on the data center computer. This linkage may be securely removed by a Withdrawal Procedure (see Appendix B) or an Exchange Procedure (see Appendix C).

Two input numbers used by the meter and the data center computer to generate encrypted codes are the configuration transaction identifier ("CTID") and the setting transaction identifier ("STID"). They are both specific to the meter and dependent upon the meter serial number. They may also be incremented after each use. The CTID is normally used for reconfiguring the meter functions and emergency remote setting and the STID is normally used for remote setting the meter postage. Separate numbers are used for separate procedures in order to maximize security and minimize complexity caused by interdependence. The encryption routine is described in greater detail below.

Emergency Setting Method

Figure 2A:
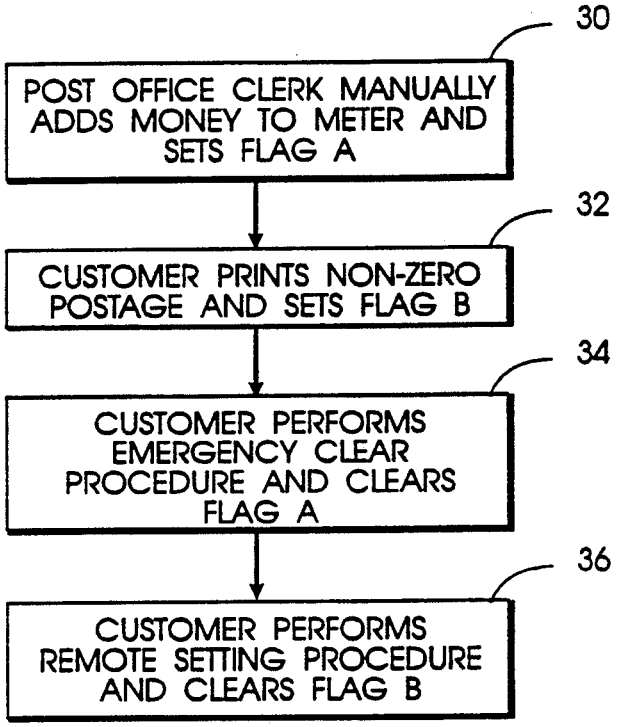
FIG. 2*a* is high level flowchart of the process for manually adding postage to the postage meter in an emergency without the remote setting code and subsequently clearing the meter for future remote settings and emergency settings.

FIG. 2*a* is a high level flow chart of the process necessary for manually adding postage to the postage meter in an emergency without the remote setting code and subsequently clearing the meter for future remote settings and emergency settings.

In a first stage 30, the customer takes the meter to the Post Office where a Post Office Clerk manually adds postage to the meter without the remote setting code. The first stage causes the meter to set a first flag (called flag A) within the meter. The meter can now be used to print postage, but it cannot be remotely set nor can the Post Office manually reset the meter again until later in the method. In a second stage 32, the customer prints some non-zero postage in order to set a second flag (called flag B) within the meter. As before, the meter can still be used to print postage but it cannot be remotely set nor can the Post Office manually set the meter again until later in the method. In a third stage 34, the customer then performs an emergency clear procedure in order to notify the data center computer of the manual setting performed by the Post Office. This stage causes the meter to clear flag A, thereby allowing the meter to be remotely set and to print postage, but not to be manually set by the Post Office. Due to security concerns, the meter must be remotely set at least once between manual settings. In a fourth stage 36, the customer performs a remote setting procedure, thereby causing the meter to clear flag B. The meter may now set remotely or manually.

Figure 2B:
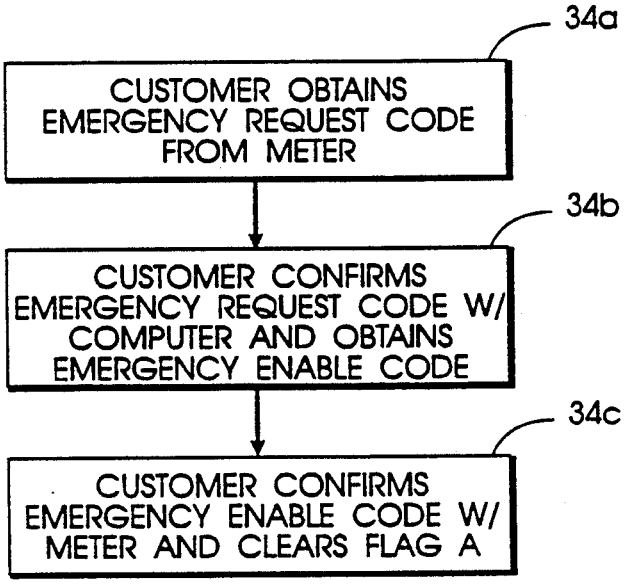
FIG. 2*b* is a high level flowchart of the process for notifying the data center computer of the manual setting.

FIG. 2*b* is a high level flowchart of the process for notifying the data center computer of the manual setting as shown in stage 34 of FIG. 2*a*. In first substage 34*a*, the customer obtains an emergency request code generated by the meter. This emergency request code is essentially a password to the data center computer, and is based on a combination of factors, the combination of which only the data center computer would know. In a second substage 34*b*, the customer confirms the emergency request code with the data center computer. Upon confirmation from the computer, the computer provides an emergency enable code back to the customer. The emergency enable code is essentially a password from the data center computer to the meter stating that it is permissible to be remotely set by the emergency remote setting amount. In a third substage 34*c*, the customer enters the emergency enable code into the meter. The meter confirms the emergency enable code with an internally generated emergency enable code and thereby clears flag A.

Figure 3:
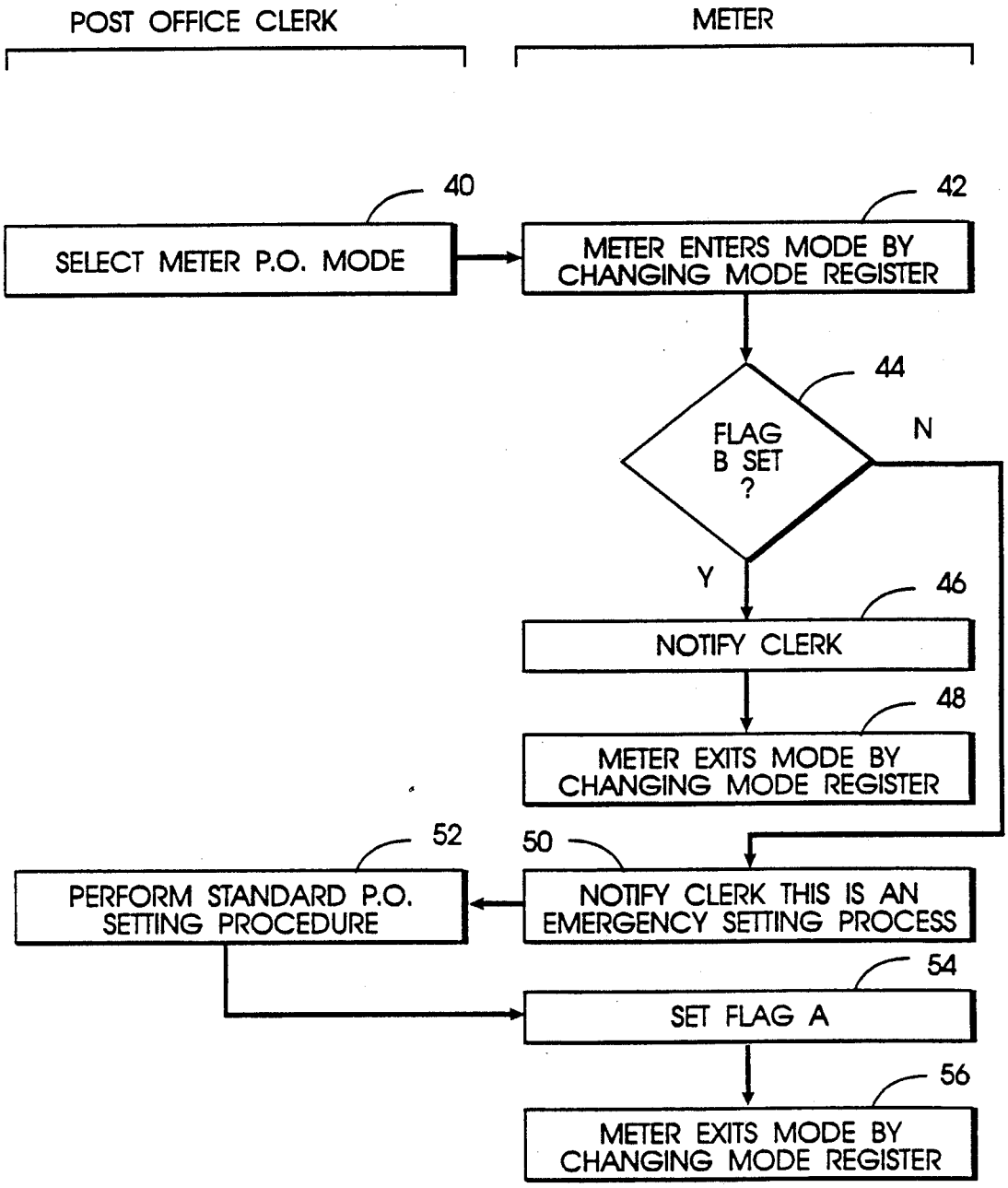
FIG. 3 is a detailed flow chart of the procedure for the Post Office Clerk to manually add postage to the meter.

FIG. 3 is a detailed flow chart of stage 30 as shown in FIG. 2*a*. Some meters have displays that are sophisticated and allow for user prompting. Therefore, in each of the steps described below, where the meter requires certain information in order to move to the next step, some meters may prompt the user to make that step.

In a first step 40, the customer takes the meter to a Post Office where a Post Office Clerk puts the meter into a Post Office mode by pressing a certain key sequence. This prevents customers and other unauthorized personnel from accidentally entering the Post Office mode. The meter then enters the Post Office mode by setting a mode register located in BAM (step 42). This prevents the meter from being used for printing purposes while performing this procedure.

The meter then checks whether a flag B is already set. Due to a security requirement that only one manual setting procedure be performed between remote setting procedures, flag B is set every time the manual setting procedure is completed and non-zero postage is printed and is cleared when an emergency clear procedure and a remote setting procedure is performed. If flag B is set, then the meter displays an error message to the Post Office Clerk (step 46), then exits the Post Office mode (step 48).

If flag B is not set (step 44), then the meter notifies the Post Office Clerk that the meter is a remote setting meter and that this procedure is an emergency setting procedure (step 50). If the meter were not remote setting, then the meter would be in a standard manual setting mode. Once notified, the Post Office Clerk then performs a manual setting procedure (step 52). The manual setting procedure includes entering a setting amount (which would be an emergency setting amount under the present circumstances) and using a Post Office key, thereby authorizing the meter to print the setting amount of postage. The customer is then given a form 3603 by the Post Office Clerk as a receipt. The meter then sets flag A signifying that the meter is enabled has been manually set by the Post Office (step 54). The meter then exits the Post Office mode by setting the mode register (step 56). The meter can now be used to print postage. The meter can subsequently be returned to the Post Office for modification of the emergency setting amount before printing any non-zero postage by repeating the above procedure.

Figure 4:
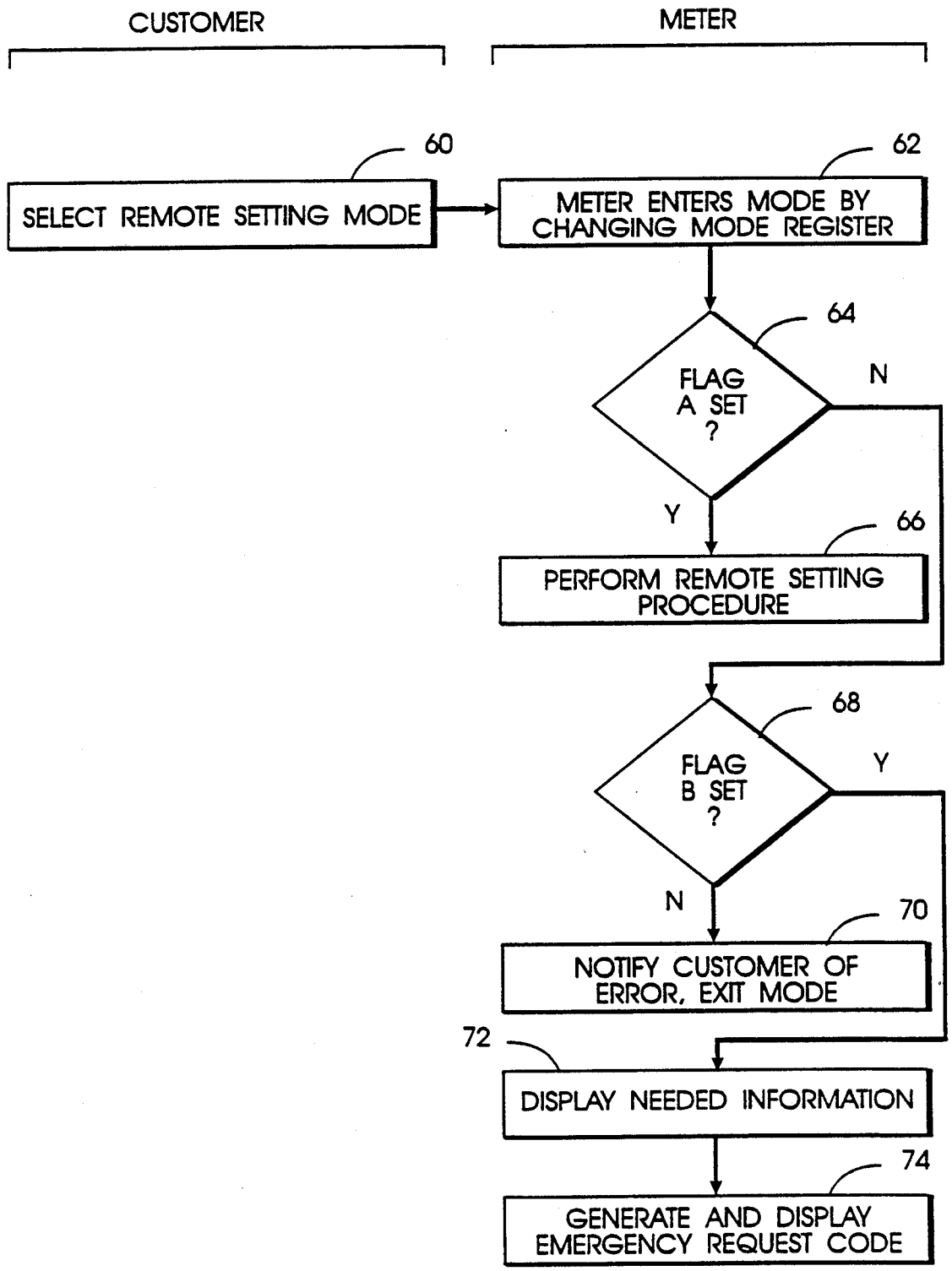
FIG. 4 is a detailed flowchart of the procedure for the customer to obtain an emergency request code generated by the meter.

FIG. 4 is a detailed flow chart of substage 34*a* as shown in FIG. 2*b*.

In a first step 60, the customer puts the meter into a remote setting mode by pressing a certain key sequence. This prevents the customer from accidentally entering the remote setting mode. Upon entry of the key sequence, the meter enters the remote setting mode by setting the mode register in BAM (step 62). This prevents the meter from being used from printing postage while being remotely set.

In step 64, the meter tests whether flag A is already set (meaning that an emergency setting procedure has not been performed since the last remote setting procedure). If flag A is set, then the meter allows the customer to perform the standard remote setting procedure (step 66) which would clear flag A as in stage 36 at FIG. 2*a*.

If flag A is not set, then in step 68 the meter tests whether flag B is set (meaning that the Post Office has manually set the meter and that the meter has printed non-zero postage). If flag B is not set, then the customer is notified that non-zero postage is needed to be printed and the meter exits the mode (step 70).

If flag B is set, then the meter then displays information needed later in the method (step 72). This includes the Ascending Register amount, the Descending Register amount, the emergency resetting amount and the emergency request code. The Ascending Register contains the amount of postage the meter has printed since the meter has been initialized. The Descending Register contains the amount of postage the meter is presently authorized to print. The meter then generates and displays an emergency request code (step 74). The emergency request code is a code generated by the meter which is partially based on the Ascending Register amount, and the STID. The encryption process is described in greater detail below.

Figure 5:
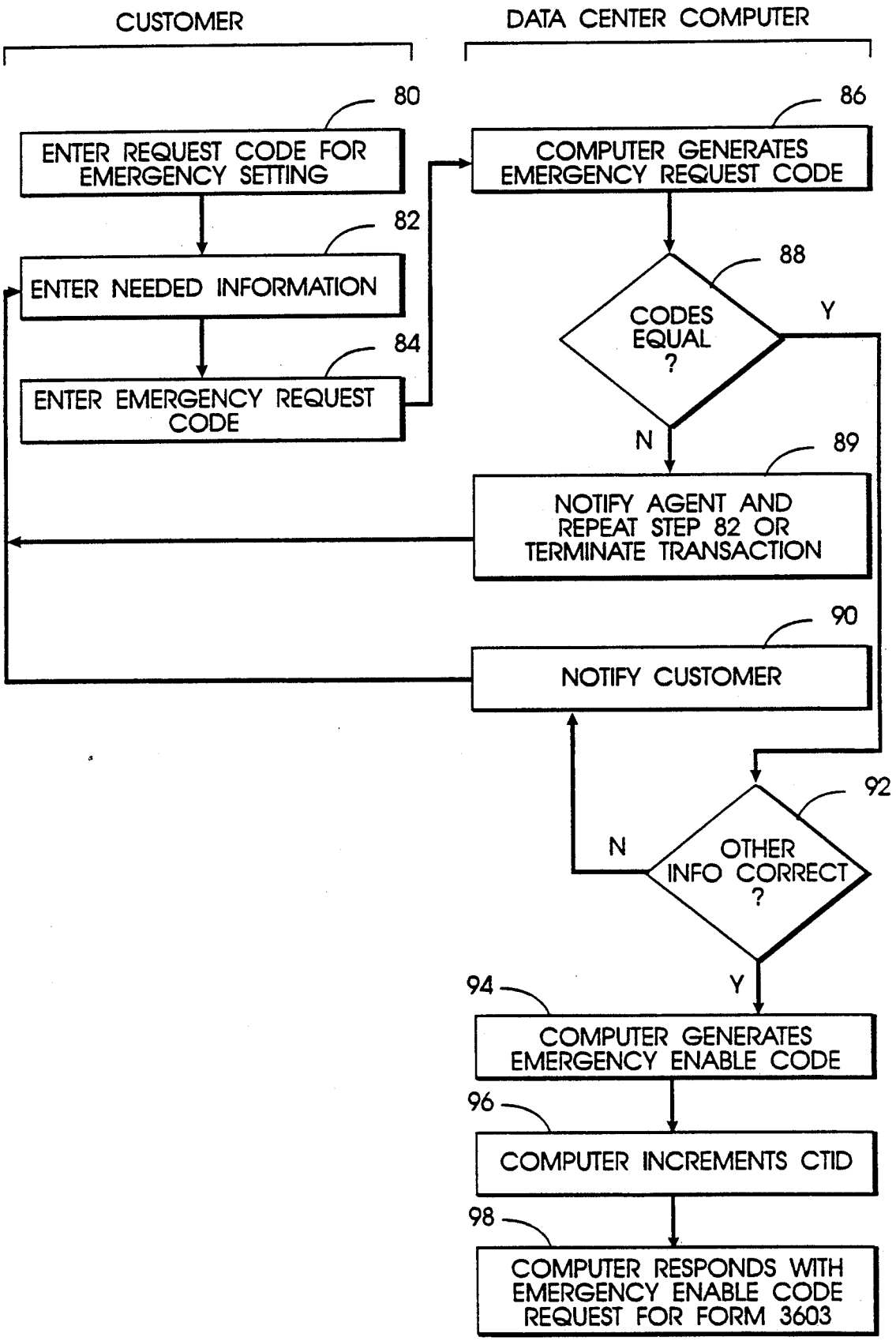
FIG. 5 is a detailed flowchart of the procedure for the customer to confirm the emergency request code with the data center computer.

FIG. 5 is a detailed flowchart of substage 34*b* as shown in FIG. 2*b*. The customer establishes communication with the data center computer 120 over a standard telephone. The customer may communicate with the data center computer on a touch tone telephone by pressing the keys. Alternative embodiments may utilize a telephone communications device that includes a user or meter interface and a modem, or by voice recognition over a telephone.

The customer first enters a request code (which describes that the agent is attempting to do an emergency clear procedure for a meter) and a password to the computer (step 80).

The customer enters the meter serial number which can also be found on the exterior of the meter. The customer then enters the customer account number, the Ascending Register amount, the manual setting amount, and the Descending Register amount, some of which were previously obtained and written down above (step 82).

The agent then enters the emergency request code from the meter (step 84). From the information above, the computer is also able to generate an emergency request code (step 86). The computer checks that its emergency request code matches the emergency request code generated by the meter (step 88). If they do not match, then the computer checks emergency request codes dependent upon prior STIDs. This enables the computer to determine how many remote settings are outstanding. If the codes still do not match, then the agent has improperly entered numbers or some other error has occurred. If the codes do not match, then the agent is notified (step 89) and must repeat the above steps starting with entering the meter serial number (step 82) or terminate the transaction. The computer then checks the other information entered by the customer to see if it agrees with what is already stored on the computer (step 92). If the information does not match then some error has occurred so the customer is notified (step 90) as above.

If the two codes match and the other information is accurate, then the computer generates an encrypted emergency enable code using the CTID and the meter serial number (step 94). The encryption process is described in greater detail below. The data center computer then increments the CTID located within the computer (step 96).

The computer then communicates the encrypted emergency enable code to the customer along with a request for the form 3603 to be mailed to the meter company from the customer to validate the transaction (step 98).

Figure 6:
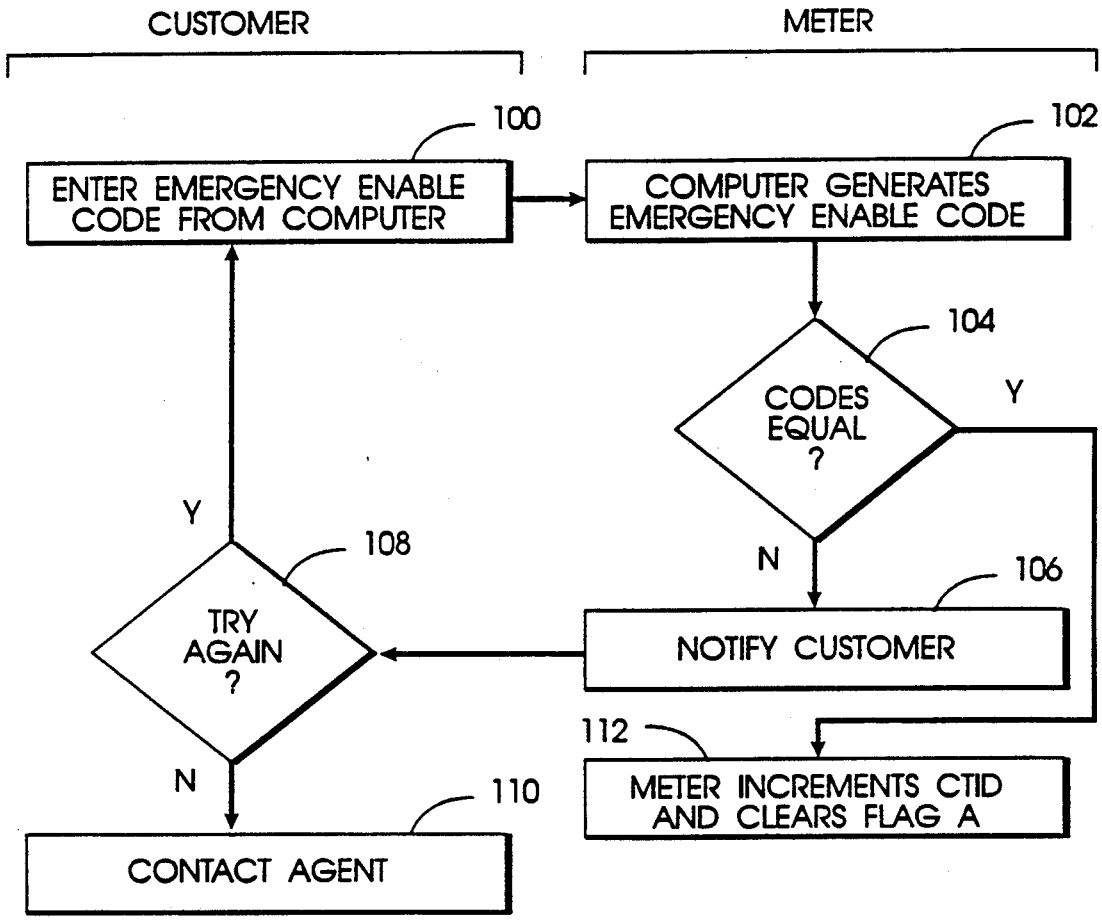
FIG. 6 is a detailed flowchart of the procedure for the customer to enter the emergency enable code into the meter.

FIG. 6 is a detailed flowchart of substage 34*c* shown above in FIG. 2*b*. The customer enters the computer generated emergency enable code into the meter (step 100). The meter then generates its own emergency enable code (step 102) and compares that code with the entered emergency enable code (step 104). If the codes do not agree, then the customer is notified (step 106). The customer may reenter the computer generated code (step 100) if the customer chooses to try again ("yes" at step 108) or call an agent at the meter company for help (step 110). If the configuration enable codes agree, then the meter knows that it is authorized to set the emergency setting amount. The meter then increments the CTID and sets flag B (step 112).

Encryption Technique

In order to perform the above procedure in a secure manner and to confirm certain data, the emergency request code and the emergency enable code are generated by an encryption routine, stored both in the meter ROM and in the data center computer. The encryption routine is a nonlinear algorithm that generates a number that is apparently random to an outside person. The encryption routine is performed by an encryption program in combination with a permanent encryption table. In the preferred embodiment, the encryption routine uses a 16 digit (or 64 bit) key and a 16 digit input number.

The emergency request code is generated by the encryption routine performed on the STID as the key and the Ascending Register amount as the input number. The configuration enable code is generated by the encryption routine performed on the CTID as the key and the meter serial number as the input number.

The CTID and STID are 16 digit numbers that are stored in BAM. The initial value of the CTID and STID are obtained by performing an algorithm upon the BAM initialization date in combination with the meter serial number. The BAM initialization date is used to prevent starting with the same CTID and STID every time the meter is initialized. The algorithm is not stored in the meter for security reasons. The initial CTID and STID are stored in BAM during the initialization process at the factory. After the computer has been notified of the manual setting procedure, the CTID is incremented by a nonlinear algorithm within the meter and the computer.

The codes generated by the encryption routine are 16-digits long. The lower digits of the codes are then communicated to the agent by the meter or the data center computer. The number of lower digits that are communicated is determined by the HSL value (see Appendix D for details).

Conclusion

It can be seen that the present invention provides a secure and efficient technique for allowing meters to be remotely set in an emergency by the customer.

While the above is a complete description of specific embodiments of the invention, various modifications, alternative constructions, and equivalents may be used. For example, the electronics of the configurable meter may be structured differently. Additionally, instead of using the tones on the telephone, a direct connection via modem can be used. Furthermore, the encryption routine could use other meter identifying information to generate the emergency request and enable codes such as the CTID or STID in both codes. For example, the encryption key used to generate the request codes could be composed of a meter cycle counter. Other security measures may be implemented such as reviewing periodic inspection of the meter.

Therefore, the above description and illustration should not be taken as limiting the scope of the present invention, which is defined by the appended claims.

APPENDIX A

INSTALLATION PROCEDURE

This procedure is performed by an agent when installing a remote setting meter at a customer's site.

Prior to this procedure, the meter must have been reconfigured (see copending application "REMOTE METER CONFIGURATION," Ser. No. 07/328,112) at least once since being initialized in order to establish a first link between the meter and the data center computer. In addition, the meter must be configured to include the remote setting feature. Furthermore, the meter cannot print postage until it has been installed.

This procedure establishes a second link between the meter, the customer, and a lease on the data center computer for accounting, billing, and security purposes. This procedure also ensures that the meter has been logged into service at the post office.

Meter at the Post Office

After reconfiguring the meter, the agent or the customer takes the meter to the Post Office to register it. Once registered, the Post Office Clerk inserts a special key in the side of the meter enabling it to be installed.

Agent at the Customer Site with the Meter

Upon arriving at a customer site with the Post Office enabled meter to be installed, the agent presses a selected key sequence to put the meter in an installation mode. The meter then displays in sequence several numbers which the agent should write down for later use in this procedure. The meter first displays the amount stored in two of the accounting registers, the Descending Register and the Control Register. The Descending Register contains the amount of postage the meter presently has for printing postage. The Ascending Register contains the amount of postage the meter has been credited since the meter left the factory. The Control Register contains the sum of the Descending and Ascending Register amounts. The meter then displays an Installation Registration Code ("IRC"). The IRC is also an encrypted number dependent upon meter specific data and may include the STID. The meter then prompts for an encrypted Installation Setting Code ("ISC") which is dependent upon the STID.

Agent with the Data Center Computer

The agent then contacts the data center computer and enters a standard installation request code, thereby notifying the computer that the agent is in the process of performing an installation procedure. The agent then enters the agent's number, the agent's authorization code, the number of the customer lease for the meter, the serial number of the meter to be installed and other similar numbers. The computer tests the serial number for validity. If the serial number is invalid, the agent should recheck and reenter the serial number or terminate the transaction.

If the serial number is valid, the agent enters the Descending Register amount, the Control Register amount, and the IRC. The computer then internally generates the IRC and compares it with the meter generated IRC. If the codes are unequal for any reason, then the agent should repeat the above process beginning with entering the serial number of the meter to be installed.

The data center computer generates and communicates the ISC, which the meter has prompted for, and increments the STID. The computer then internally flags that the meter is installed at the customer site.

Agent at the Meter

The agent returns to the meter and enters the computer generated ISC. The meter then internally generates an ISC and compares it with the entered installation code. If the codes are not equal, the meter will not accept the code. The agent may then obtain the current ISC from the data center computer again. Unlimited retries are permitted. If the codes are equal, the meter then increments the STID and sets an installation flag in BAM thereby allowing the meter to be remotely set and to print postage.

APPENDIX B

WITHDRAWAL PROCEDURE

This procedure is performed by an agent when withdrawing a remote setting meter from a customer site. This procedure removes the second link between the meter, the customer and the lease on the data center computer. In addition, this procedure prevents the meter from being remotely set. Furthermore, this procedure allows the meter to be reconfigured to change the fixed reset amount, or to a non-remote setting meter, installed at another customer site, or returned to the factory.

Agent with the Data Center Computer:

The agent contacts the data center computer and enters a standard withdrawal request code, thereby notifying the central computer that the agent is in the process of performing a withdrawal procedure. The agent then enters the agents number, the agent's authorization code, and the serial number of the meter and other data to be withdrawn. The data center computer tests the serial number for validity. If the serial number is invalid, the agent should recheck and reenter the serial number. If the serial number continues to be invalid, then the meter is not properly registered on the central computer and the agent should contact the factory for further instructions.

If the serial number is valid, the agent enters a reason code. The reason code is a alphanumeric value which represents the reason why the meter is being withdrawn. The data center computer then internally generates an encrypted Withdrawal Setting Code ("WSC"). The data center computer then flags the meter as being withdrawn and increments the meter STID.

Agent at the Meter:

If the meter is not functional, the agent returns the meter to the factory. If the meter is functioning then the agent presses a selected key sequence to put the meter in a withdrawal mode. The agent then enters the computer generated WSC into the meter. The meter then internally generates the WSC and compares it with the computer generated WSC. If the codes are not equal, the meter will display an error message and the agent reenters the computer generated WSC. Unlimited retries are permitted. If the codes are equal, the meter then increments the STID and clears the installation flag in BAM.

Meter at the Post Office

After withdrawing the meter, the agent or customer takes the meter to the Post Office to close the registration previously performed in the Installation Procedure (see Appendix A). Once the registration is closed, the Post Office Clerk inserts a special key in the side of the meter thereby completing the Withdrawal Procedure.

APPENDIX C

EXCHANGE PROCEDURE

This procedure is performed by an agent when replacing a meter at a customer's site with another meter. This procedure is merely a combination of the withdrawal of the old meter and installation of the new meter at the customer site. Each of the steps for the meters are the same as described in the Installation and Withdrawal Procedures (see Appendices A and B) except the agent is able to perform the procedures with only a single communication with the computer.

APPENDIX D

VARIABLE LENGTH SECURITY CODES

An algorithm is used to generate an apparently random code with multiple digits. However, only a selected number of digits (usually the lower digits) of this code needs to be used in most applications. The number of digits needed depends upon the level of security needed. It is preferred to use as few digits as possible to decrease the number of keystrokes that must be entered, thereby increasing convenience and decreasing the potential for error.

As a result, a variable has been created which defines the overall level of security required by the meter or data center computer. This variable is called the high security length ("HSL") value.

Each code generated by the meter or data center computer has a variable length of digits used depending upon the HSL value. That is, if the HSL value is 1, then the emergency request code should have 6 digits. If the HSL value is higher, then the emergency request code should be longer. Other codes may have different lengths for a given HSL value, but each code will increase or decrease in length if the HSL value is increased or decreased.

This predetermined relationship between code length and the HSL value allows the meter manufacturer to increase or decrease security for the meter without having to recover and initialize each meter. Changes in the HSL value are communicated to the meter when performing a remote meter configuration (see copending Application "REMOTE METER CONFIGURATION," Ser. No. 07/328,112.

In an alternative embodiment, multiple security variables may be used to vary the lengths of individual or groups of codes without affecting the length of the remaining codes.

What is claimed is:

1. A method of operating an electronic remotely settable postage meter, the meter having a value representative of available postage, a flag, and meter identifying data stored in memory, being remote form a data center computer, and having a first mode of operation for printing postage if the value representative of available postage is greater than zero, a second mode of operation for manually adjusting the value representative of available postage, and a third mode of operation for communicating a manual adjustment to the data center computer, the method comprising the steps of:

(a) placing the meter in the second mode if the flag is clear;

(b) entering into the meter a manual adjustment, thereby increasing the value representative of available postage by the manual adjustment amount and causing the flag to be set;

(c) placing the meter in the third mode if the flag is set;

(d) calculating at the meter a meter generated emergency enable code that depends on the identifying data;

(e) establishing communication with the data center computer;

(f) entering into the data center computer the identifying data and the manual adjustment;

(g) calculating at the data center computer a computer generated emergency enable code that depends on the identifying data;

(h) entering the computer generated emergency enable code into the meter;

(i) comparing at the meter the meter generated and computer generated emergency enable codes; and (j) clearing the flag if the codes are equal

2. The method of claim 1 wherein steps (f) and (g) further comprise the steps of:

calculating at the meter a meter generated emergency request code; and entering the meter generated emergency request code into the data center computer as the identifying data.

3. A method of manually setting an electronic remote setting postage meter, the meter having a stored value representative of available postage, a first flag, a second flag, and meter identifying data stored in memory, being remote from a data center computer, and having a first mode of operation for printing postage if the stored value representative of available postage is greater than zero, a second mode of operation for manually adjusting the stored value representative of available postage, a third mode of operation for communicating a manual adjustment to the data center computer, and a fourth mode of operation for remotely setting the postage setting, the method comprising the steps of:

(a) placing the meter in the second mode if the first and second flags are clear;

(b) entering into the meter a manual setting value, thereby increasing the stored value representative of available postage by the manual adjustment and causing the first flag to be set;

(c) placing the meter in the first mode if the first flag is set and the second flag is clear;

(d) printing some non-zero postage thereby decreasing the stored value representative of available postage and causing the second flag to be set;

(e) placing the meter in the third mode if the first and second flags are set;

(f) calculating at the meter a meter generated emergency enable code that depends on the identifying data;

(g) establishing communication with the data center computer;

(h) entering into the data center computer the identifying data and the manual adjustment;

(i) calculating at the data center computer a computer generated emergency enable code that depends on the identifying data;

(j) entering the computer generated emergency enable code into the meter;

(k) comparing at the meter the meter generated and computer generated emergency enable codes;

(l) clearing the first flag if the codes are equal;

(m) placing the meter in the fourth mode if the first flag is clear and the second flag is set; and (n) remotely setting the meter, thereby clearing the second flag.

4. The method of claim 3 wherein steps (h) and (i) further comprise the steps of:

calculating at the meter a meter generated emergency request code; and entering the meter generated emergency request code into the data center computer as the identifying data.

5. An electronic postage meter having a memory with a value representative of available postage and capable of being modified by entry of a remote setting code, the meter comprising:

(a) entry means capable of entering an emergency enable code;

(b) flag means for preventing the value representative of available postage from being modified by a remote setting code, the flag means capable of being set and cleared;

(c) means, coupled to the memory and the flag means, for manually setting the value representative of available postage without entering the remote setting code, thereby increasing the value representative of available postage and setting the flag means to prevent the value representative of available postage from being modified by a remote setting code;

(d) enable code means for generating an emergency enable code;

(e) comparing means, coupled to the entry means, the enable code means and the flag means, for comparing the generated emergency enable code with the entered emergency enable code; and (f) means for clearing the flag means if the emergency enable codes agree.

6. The postage meter of claim 5 further comprising:

(f) means, for generating an emergency request code; and (g) means, coupled to the emergency request code generating means, for displaying the emergency request code.

7. An electronic postage meter having a memory with a value representative of available postage and capable of being modified by entry of a remote setting code, the meter comprising:

(a) entry means capable of entering an entered emergency enable code;

(b) first flag means for preventing the postage amount from being modified by a remote setting code, the first flag means capable of being set and cleared;

(c) second flag means capable of being set and cleared;

(d) means, coupled to the memory and the first flag means, for manually setting the value representative of available postage without entering the remote setting code, thereby increasing the value representative of available postage and setting the first flag means to prevent the value representative of available postage from being modified by a remote setting code;

(e) means, coupled to the memory and the first and second flag means, for generating an emergency enable code if the first and second flag means are set;

(f) enable code means, coupled to the first and second flag means, for generating an emergency enable code if the first and second flag means are set;

(g) comparing means, coupled to the entry means, the enable code means, and the second flag means, for comparing the generated emergency enable code with the entered emergency enable code;

(h) means for clearing the first flag means if the emergency enable codes agree; and (i) means, coupled to the entry means and the first and second flag means, for clearing the second flag means upon the entry of a remote setting code if the first flag means is clear.

8. The postage meter of claim 7 further comprising:

(j) display means; and (k) means, coupled to the emergency request code generating means, for displaying the emergency request code on the display means.

9. A method of setting a postage meter manually and remotely, the postage meter having a first flag, and a second flag, comprising the steps of:

(a) placing said meter in a first mode with said first and said second flags in a first state, said first mode permitting manual or remote setting of a value representative of available postage;

(b) thereafter, placing said meter in a second mode when said first flag is in a second state and said second flag is in said first state, said first flag placed in said second state by a post office interface to said meter, said second mode permitting only manual resetting of said value representative of available postage;

(c) thereafter, placing said meter in a third mode when said first and second flags are in said second state, said second flag set to said second state by printing non-zero potage, said third mode permitting neither remote nor manual resetting of said value representative of available postage, said second flag placed in said second state by said post office manually resetting said meter;

(d) thereafter, placing said meter in a fourth mode when said first flag is in said first state and said second flag is in said second state, said fourth mode permitting only remote resetting of said value representative of available postage, said first flag placed in said first state by a user interfacing with a data center computer; and (e) thereafter, placing said meter in said first mode again, said second flag set to said first state by remotely resetting said value representative of available postage.

* * * * *